114-253 SR
1/19/88 XR 4,719,870

United States Patent [19]
Whitley, II

[11] Patent Number: 4,719,870
[45] Date of Patent: Jan. 19, 1988

[54] QUICK-RELEASE SKI TOW BRACKET

[75] Inventor: Warwick M. Whitley, II, Panama City, Fla.

[73] Assignee: Attwood Corporation, Lowell, Mich.

[21] Appl. No.: 14,223

[22] Filed: Feb. 12, 1987

[51] Int. Cl.[4] ..... B63B 21/04
[52] U.S. Cl. ..... 114/218; 114/253; 24/127
[58] Field of Search ..... 114/218, 253, 254; 24/127

[56] References Cited

U.S. PATENT DOCUMENTS

| | | | |
|---|---|---|---|
| 183,144 | 10/1976 | Cruickshank . | |
| 1,125,755 | 1/1915 | Sommers et al. | 24/127 |
| 1,756,356 | 4/1930 | Hill | 24/127 |
| 2,585,160 | 2/1952 | Munn . | |
| 2,870,733 | 1/1959 | Winther | 114/218 |
| 2,943,591 | 7/1960 | Schneider | 114/253 |
| 3,126,859 | 3/1964 | Bigelow | 114/218 |
| 3,181,861 | 5/1965 | Wilkinson . | |
| 3,597,808 | 8/1971 | Johnson | 114/218 |
| 3,650,237 | 3/1972 | Hartman . | |
| 3,828,714 | 8/1974 | Perkins | 114/218 |
| 3,890,918 | 6/1975 | Sell . | |
| 4,233,923 | 11/1980 | Casad et al. . | |

FOREIGN PATENT DOCUMENTS 944537 4/1974 Canada .

*Primary Examiner*—Joseph F. Peters, Jr.
*Assistant Examiner*—Stephen P. Avila
*Attorney, Agent, or Firm*—Price, Heneveld, Cooper, DeWitt & Litton

[57] ABSTRACT

An anchor member for detachably securing a rope having a loop at one end to a boat includes a member of sheave-like design having a circumferential groove to seat the rope loop. The member is largely enclosed by a cover having a peripheral flange forming an internal chamber open at one end and only slightly radially larger than the member. The flange has a circumferential opening wide enough to permit both sides of the loop to pass through it when the loop is seated in the groove. The cover is secured to the member for both rotation and axial movement and resiliently biased to telescopically seat over the member and substantially cover the groove but easily lifted by an operator to expose the groove for attachment and removal of the rope.

7 Claims, 7 Drawing Figures

QUICK-RELEASE SKI TOW BRACKET

FIELD OF THE INVENTION

This invention relates to means for anchoring a ski tow rope to a boat. Particularly is it designed to eliminate the necessity for using fasteners or any knots to attach the rope to or detach it from the boat.

BACKGROUND OF THE INVENTION

Since ropes for water skiing are, for numerous reasons, seldom left attached to a boat they must be attached and removed at the beginning and end of each use of the boat for water skiing. This can be a lengthy and frustrating operation and, in many cases, involves equipment which can be the source of annoying difficulties to either prepare for use or for removal. Keeping in mind that water skiing is always done in an environment which has a tendency to cause any metallic fasteners to corrode, unless they are heavily plated or are of a non-corrosive alloy, it is desirable to avoid the use of such fasteners. The non-corrosive alloys are very expensive when used for this purpose and non-metallic materials lack the necessary strength. Therefore, it is desirable to provide a simple device which would be quick and easy to use both when the rope is attached and when the rope is removed. Further, it would be desirable to provide such a device which is easily assembled and installed on the boat and which can be made of relatively inexpensive materials which will not be subject to corrosive action in the environment of their use. It is also desirable to provide such a device which is compact and will not interfere with the use of other accessories and, also, will not damage the rope itself. The device must provide freedom of the rope to pivot about its support as the skier moves from one side of the boat to the other. It is also essential that the device provide a dependable, positive anchor for the rope which will not inadvertently release during use and can also withstand the substantial forces which are imposed on it both when the skiing operation is initiated and during the actual period of skiing.

BRIEF DESCRIPTION OF THE INVENTION

The invention provides a rope anchor which has the shape and general characteristics of a sheave which cooperates with and is substantially covered by a cap so designed that merely by placing the end loop of the rope around the cap and giving the rope a sharp pull, the loop at the end of the rope surrounding the anchor will cause the rope to automatically seat within the device. Thereafter the cap will hold the rope against any inadvertent release. Alternatively, the cap can be lifted by hand to provide access permitting the rope to be placed around the anchor. The invention eliminates the necessity for any fasteners, since the rope only has to be looped around the rope anchor. The anchor and cap can be made almost entirely of molded plastic materials. Further, the device provides a compact anchor means which can be mounted on a deck or the back panel adjacent the transom of a boat and being of low silhouette will not interfere with any other accessories which may be mounted on the deck and will also have a neat and unobtrusive appearance. The invention is such that although the rope is positively held against inadvertent release to detach the rope all that is necessary is to lift the cap and remove the rope loop.

DESCRIPTION OF THE PREFERRED EMBODIMENT

Figure 3:
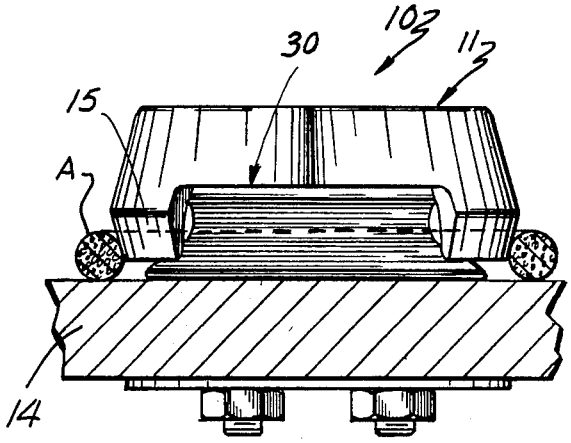
FIG. 3 is a rear elevational view of the invention with the rope seated around the anchor before being caused to enter the anchor and become seated around the anchor block.
Figure 4:
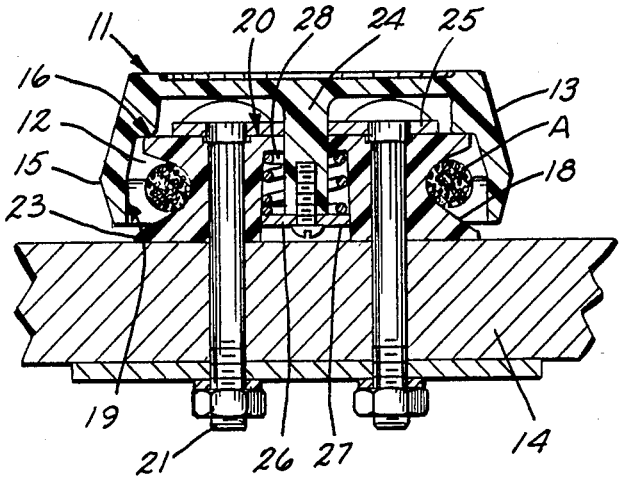
FIG. 4 is a sectional view taken along the plane IV—IV of FIG. 2.

The numeral 10 identifies a rope anchor having a cover or cap 11 of circular configuration which is hollow or recessed on the inside to form a chamber 12 (FIG. 4). The chamber is surrounded by a peripheral flange 13, the upper portion of which is flared outwardly toward the mounting surface or deck 14 but the lower portion of which is formed into a lip 15, the external surface of which is inclined inwardly and downwardly toward the deck 14. While this angle of inclination can vary somewhat, a preferable angle from the vertical is about 15°. The inner surface 19 of the lip is vertical, up to about the point where the lip joins the upper portion of the exterior surface. Thereafter, the internal face of the peripheral flange 13 is inclined radially inwardly and terminates in an inwardly directed annular shoulder 16. The shoulder is designed to seat on the sheave-like rope anchor block 20. The rope anchor is rigidly secured to the surface or deck 14 by suitable means such as the bolts 21. The bolts hold the anchor block stationary. The outer periphery of the anchor block 20 has a peripheral channel or groove 21 very similar to that of a sheave or pulley. The upper or inner lip of the anchor block which forms the base on which the shoulder 16 rests preferably does not extend radially out as far as the lower lip or flange 23. Also, the lower lip 23 at its outer periphery is thinner and presents less of a vertical wall at its outer end, as is clearly shown in FIG. 4. The inner face of the anchor block 20 is pulled tightly against the surface 14, as is illustrated FIGS. 3 and 4.

The cap 11 has a central, downwardly extending post which passes through an opening in both the plate 25 for the bolts 21 and the center of the anchor block 20 into a socket 26. The socket opens through the bottom face of the anchor block. The end of the post mounts a stop washer 27 which provides a bearing surface for one end of the compression spring 28. The upper end of the compression spring seats against the upper end of the socket 26 and, thus, biases the cap downwardly to seat shoulder 16 on the top of the anchor block. The shoulder 16 limits downward movement of the cap holding the end of the lip 15 spaced from the adjacent surface of the supporting panel 14. It is essential that the cap and its post be capable of rotation with respect to the anchor block with little resistance.

Figure 6:
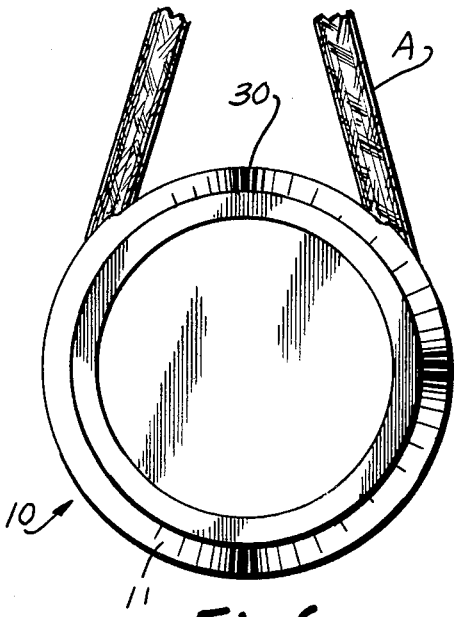
FIG. 6 is a view similar to FIG. 5, illustrating the position of the rope after it has been secured.

The cap 11 has an elongated rope access opening in its lower face having a vertical height such that its upper edge is approximately at the top of the rope groove 18 of the anchor block when the cap is seated on the top of the anchor block. This opening has a circumferential width of approximately 90°. The inner edges of the flange at both ends of the opening are preferably radiused to avoid wear on the rope A, as will be understood from FIG. 6.

Preferably, the cap 11 and the rope anchor block 20 are molded of a suitable environmental stabile plastic, such as vinyl or acrylonitrile butadiene styrene (ABS) which will withstand the effects of long-term exposure to ultraviolet radiation and are also strong enough the withstand the incident to use of the invention.

Figure 1:
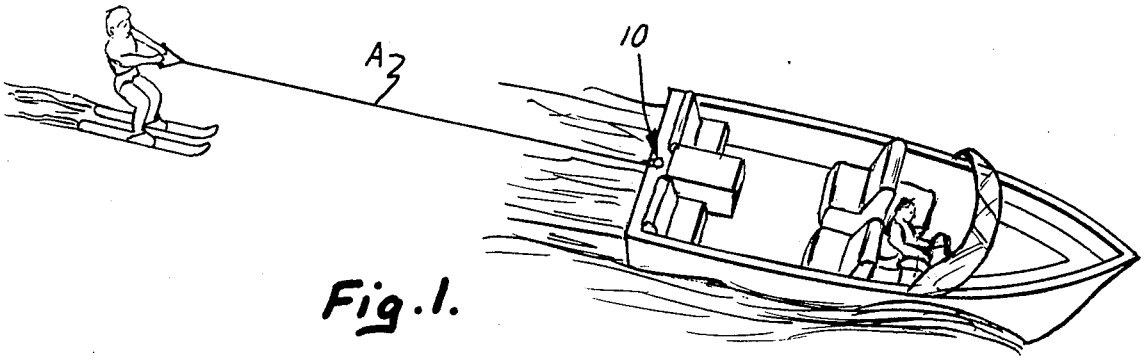
FIG. 1 is an oblique view of a boat equipped with this invention.
Figure 2:
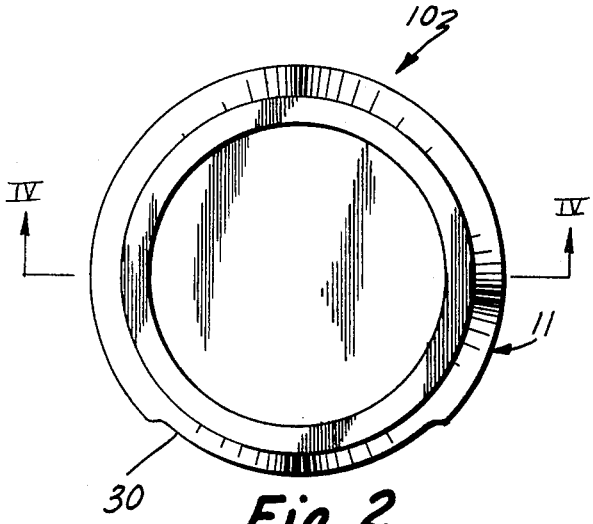
FIG. 2 is a top plan view of a rope anchor incorporating this invention.
Figure 5:
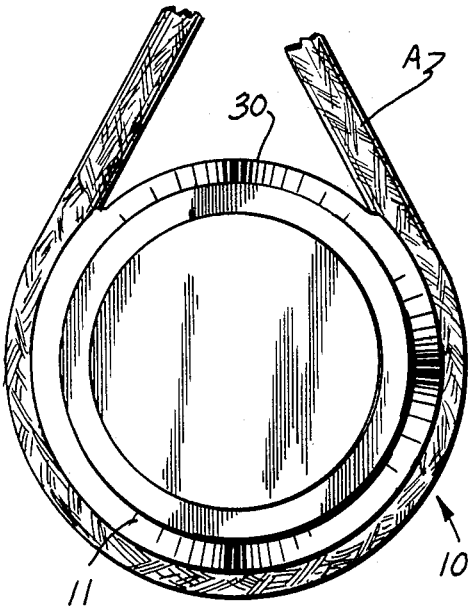
FIG. 5 is a plan view of the invention with the rope placed ready to be secured.

Preferably, the invention is mounted to the deck or the deck-like panel at the top of the transom at the aft end of a boat, as is indicated in FIG. 1. Once the invention has been mounted securely to the boat, to attach a rope, the rope is provided with a closed loop at one end which loop can simply placed around the rope anchor with the opening 30 extending toward the rope. It will be noted from FIGS. 3 and 5 that when the rope is so seated, it is slightly recessed under the cap due to the inwardly radially inclined face of the lip 15. In this position, when the rope is pulled taut such as by a hard pull exerted by the operator, the rope A, because of the inclination of the exterior surface of the lip 15, will create an upward biasing pressure against the cap, forcing it to rise against the resistance of the spring 28 until the rope can pass under the lip and enter the chamber 12 within the cap. The rope will then automatically seat in the bottom of the groove 18, as is shown in FIG. 4. When the rope seats in the groove, the cap will be released and the spring will automatically return it to its normal position. The rope, thereafter, will extend out of the cap 11 through the opening 30. It is because of this that the radiusing of the inner edges of the cap at the sides of the opening 30 is important to avoid wear on the rope. It will noted that there is nothing to restrict rotation of the cap and, thus, as the skier at the end of the rope moves from one side of the boat to the other, the cap is able to pivot with the rope so that the opening 30 remains at all times aligned with the rope.

During water skiing, particularly when starting, the bow of the boat is inclined sharply upwardly. This will cause the rope, where it passes through the opening 30, to apply an upwardly acting force vector against the cover. This will be strong enough to overcome the bias of the spring 28. However, should the force be great enough to cause the rope to shift radially outwardly along the upper wall of the groove 18 it will become wedged between the upper flange of the anchor member and vertical inside face 19 of the lip 15. At this point all further upward force necessary to display the cover would have to be applied by the rope to the cover where it passes through opening. To displace the cover from the anchor member would require an angular relationship between the rope and the central axis of the anchor member which far exceeds any angular position which the boat could attain while pulling a water skier. It will be observed from FIG. 3 that the cover 11 would have to be lifted at the opening 30 to an angle substantially exceeding that which the boat will assume at start up before the combination of the upper flange of the anchor member and the lip of the flange would allow the rope to escape the confining effect of the sides of the opening 30. The result of this design is that the invention positively assures retention of the rope.

When skiing is completed and it is desired to detach the rope, all that has to be done is to lift the cap and remove the rope from inside the chamber 12 of the cap. However, during the time the rope is in actual use, the cap positively prevents the rope from becoming inadvertently detached from the anchor because the loads applied to the rope will always bias it to seat in the bottom of the groove where the upper flange of the anchor block absorbs any vecta of upwardly acting force. Even when slack, the cap, in effect, holds the loop of the rope securely within the internal chamber from which it cannot escape unless an operator intentionally lifts the cap against the resistance of the spring 28 sufficiently to free the rope. It will be understood that the spring 28 need not offer great resistance to the lifting of the cap, since the rope, under all normal operating conditions will have no tendency to lift the cap and thereby compress the spring. The spring's only function under these circumstances is to retain the cap in its retracted position. Thus, a relatively weak spring can be utilized. The diameter of the stop washer 27 is such that in conjunction with the walls of the past opening through the plate 25 and the upper position of the anchor block it will prevent the cap rocking about its opening through the plate 25 and the upper end of the rope anchor 20.

It will understood that within limits the diameter of the rope must be compatible with the size of the anchor 10. In other words, it must be able to seat within the groove of 18 without projecting out radially in a manner which would interfere with the proper seating of the cap and also will pass between the cap and the lower flange 23 without requiring movement of the cap exceeding that permitted by the length of the spring and socket in which the spring is mounted.

Figure 7:
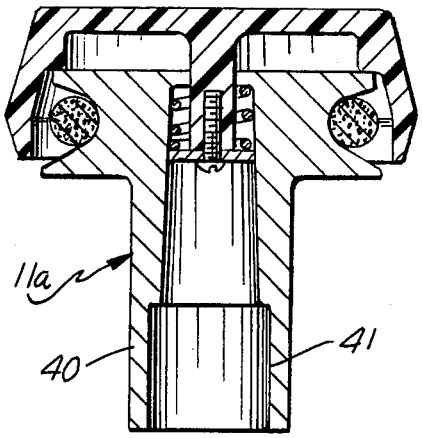
FIG. 7 is a view similar to FIG. 4, illustrating a modified form of the invention.

FIG. 26 illustrates the invention applied to a pole mount. The entire mechanism is the same as that illustrated in FIGS. 1–6 except that the anchor block **11*a* has an elongated tubular sleeve 40. The lower end of the sleeve has a counterbore 41 recessed into its lower end to receive the end of the pole. The function of the construction illustrated in FIG. 7 is identical to that illustrated in FIGS. 1–6 except that the rope must always be attached by manually lifting the cap 11 to provide rope access to the groove 18**.

Having described a preferred embodiment of the invention, it will be understood that other embodiments can be made without departing from the principles of the invention. Such modifications are to considered as included in the hereinafter appended claims unless these claims by their language expressly state otherwise.

I claim:

1. Means for securing a rope having a loop at one end to a boat for water skiing comprising: a sheave-like circular anchor member having a recessed peripheral groove for seating the rope loop; and fastener means for securing the same to a support; a cover having a central recess for receiving said anchor member therein; means mounting said cover to said anchor member; said mounting means including a central post depending from said cover supporting said cover for both rotation and axial movement with respect to said anchor member; said cover having a peripheral flange surrounding said anchor member and having a free edge spaced from said anchor member substantially less than the thickness of the rope to be used with it, said cover being axially moveable between a retracted position substantially enclosing said groove and a release position permitting the loop of a rope to enter said groove; means resiliently urging said cover into retracted position; said flange having a circumferentially extending opening of a circumferential width and axial height to permit both sides of the loop of a rope seated in the groove of said anchor member to pass therethrough without interference with said cover when the cover is in retracted position.

2. Means for securing a rope having a loop at one end to a boat as described in claim 1 wherein the inside surface of the flange of said cover is substantially parallel to the axis of said anchor member whereby the loop of the rope will be trapped between the anchor member and said flange preventing the rope from lifting the cover sufficiently to effect a rope release when the bow of the boat is upwardly inclined.

3. Means for securing a rope having a loop at one end to a boat as described in claim 1 wherein said cover has a radially inwardly directed shoulder seated on said anchor member when the cover is in retracted position and holding said cover such that the free edge of said cover is spaced from the adjacent end of said anchor member a distance less than the thickness of the rope.

4. Means for securing a rope having a loop at one end to a boat as described in claim 1 wherein said opening subtends a circumferential arc of at least 90°.

5. Means for securing a rope having a loop at one end to a boat as described in claim 1 wherein said anchor member has a central socket opening through the end thereof remote from said cover, said resilient means being a compression spring seated in said socket and acting against said central post.

6. Means for securing a rope having a loop at one end to a boat for water skiing comprising: a sheave-like circular anchor member having a recessed peripheral groove for seating the rope loop and fastener means for securing the same to a support; a cover having a central recess for receiving said anchor member therein; means mounting said cover to said anchor member; said mounting means including a central post depending from said cover supporting said cover for both rotation and axial movement with respect to said anchor member; said cover having a peripheral flange surrounding said anchor member and having a free edge spaced from said anchor member substantially less than the thickness of the rope to be used with it, said cover being axially moveable between a retracted position substantially enclosing said groove and a release position permitting the loop of a rope to enter said groove; means resiliently urging said cover into retracted position; said flange adjacent its free edge having a lip characterized by an outer face inclined radially inwardly toward the lip's free end whereby an axially outward force vector acting on the cover is created by a rope loop seated around the cover when the loop is pulled radially with respect to the cover; said flange having a circumferentially extending opening of a circumferential width and axial height to permit both sides of the loop of a rope seated in the groove of said anchor to pass therethrough without interference with said cover when the cover member is in retracted position.

7. Means for securing a rope having a loop at one end to a boat as described in claim 6 wherein the end of the anchor member adjacent the free end of the lip has a greater diameter than the opposite end thereof and a circumferential edge of low profile to facilitate radial movement of the rope to seat in the groove.

* * * * *